United States Patent [19]

Maringer

[11] Patent Number: 4,646,812

[45] Date of Patent: Mar. 3, 1987

[54] FLOW CASTING

[75] Inventor: Robert E. Maringer, Worthington, Ohio

[73] Assignee: Battelle Development Corporation, Columbus, Ohio

[21] Appl. No.: 778,633

[22] Filed: Sep. 20, 1985

[51] Int. Cl.[4] ..... B22D 11/06

[52] U.S. Cl. ..... 164/479; 164/463; 164/476

[58] Field of Search ..... 164/479, 463, 423, 429, 164/430, 476, 417, 477

[56] References Cited

U.S. PATENT DOCUMENTS

| | | | |
|---|---|---|---|
| 2,210,145 | 8/1940 | De Buts | 164/479 |
| 3,354,937 | 11/1967 | Jackson, Jr. | 164/479 |
| 4,274,471 | 6/1981 | Minoura et al. | 164/463 X |

FOREIGN PATENT DOCUMENTS

| | | | |
|---|---|---|---|
| 242063 | 10/1962 | Australia | 164/429 |
| 55-24710 | 2/1980 | Japan | 164/476 |
| 2010146 | 6/1979 | United Kingdom | 164/429 |

*Primary Examiner*—Kuang Y. Lin

*Attorney, Agent, or Firm*—Benjamin Mieliulis

[57] ABSTRACT

A process for casting metallic strips thicker than from melt-drag processes but thinner than the inherent normal thickness of a cast melt is disclosed. The disclosed process casts molten metal, without decanting or accelerating the molten stream, onto a channel-shaped chill surface. After casting, the molten strip acquires a high thermal gradient. Following thermal shrinkage of the underside the molten top layer is squeegeed using a chill roll to uniformly distribute and crystallize the top surface.

9 Claims, 5 Drawing Figures

(SECTION B-B)

(SECTION C-C)

FLOW CASTING

BACKGROUND OF THE INVENTION

This invention relates to methods of casting metallic sheets or strips from molten metal. More particularly, this invention relates to methods of casting relatively wide polycrystalline metallic strips having a thickness exceeding that obtainable by melt drag processes and generally thinner than the thickness inherent in a melt attributable to surface tension of the molten metal.

This invention relates to methods of casting polycrystalline metallic strips having thicknesses of 20–500 mils at high quench rates and having top and bottom surfaces of similar and uniform crystalline microstructure.

DESCRIPTION OF RELATED ART

The rapid solidification of metals to form metal strip by the melt drag process is described in numerous patents, such as U.S. Pat. Nos. 3,522,836; 3,605,863; 4,479,528 and 4,484,614. The process generally comprises forming a meniscus of molten metal at the outlet of a tundish nozzle, and dragging a chill surface through the meniscus. Molten metal thereby contacts the chill surface and solidifies thereon to form a thin metal strip.

Melt drag processes involve puddling a molten stream and almost instantaneously accelerating the forming strip from 0 velocity to the velocity of the spinning wheel. This acceleration occurs in the process of essentially drawing the strip out of the stream puddle. Molten metal is left behind in this process as the strip formed is solidified and withdrawn as it is formed. Melt drag or melt extraction is a decantation type of process.

For clarity in understanding, the present invention, unlike decantation processes, can be thought of similar or parallel to squirting caulking paste out of a tube onto a surface moving at the same rate as the paste exudes from the tube. The element of acceleration is eliminated.

In the present invention, molten metal adheres to and rides with over the solid strip formed upon contacting the chill surface. Decantation is eliminated.

The dynamics of solid metal growth are slow. Solid growth proceeds at a rate proportional to the square root of time. It takes 4 times as long to double the strip thickness. Thus, processes relying on rapidly spinning circular chill surfaces become impractical for forming thicker strips. During cooling, gravitational forces would cause molten metal running.

Narasimhan (U.S. Pat. No. 4,142,371) discloses an apparatus for producing thin amorphous strip through a thin split discharge opening in a tundish, and depositing molten metal onto a belt-like movable chill body moving at a velocity of from 100 to 2000 meters per minute. Similar to other melt drag processes, decantation and acceleration of the melt is involved. Narasimhan produced thin strip of from 0.002–0.008 inch thickness.

Also relying on decantation and acceleration of the melt is Smith U.S. Pat. No. 4,290,476. Smith discloses an apparatus for planar flow casting of metal ribbon. The Smith apparatus includes a tundish nozzle having a planar bottom surface which includes the leading edge of a first lip and side edges at the bottom of the lips; all points on the bottom of the lips being at least as far from the chill surface as is the first lip but no further from the chill surface than about 1 mm. The chill surface is stated to ordinarily move at a predetermined velocity at least about 200 meters per minute.

The present inventive process derives a process yielding thicker metal strips, compared to the ribbons of the prior art, and having more uniform surface characteristics.

Molten metal deposited onto flat bodies has an inherent thickness due to surface tension of the melt. Until this invention, economic methods did not exist for direct casting of strip thicker than the tape-like strips of melt drag processes, but thinner than the inherent normal thickness of molten metal due to surface tension.

By enabling direct casting of strips of selective thickness, savings are immediately realizable in elimination or minimizing of costly rolling and annealing cycles.

SUMMARY OF THE INVENTION

The present invention discloses a process for casting strips of metal, more particularly strips of 20–500 mils (0.02–0.5 inch) thickness at high quench rates.

The present invention provides a new and improved process for casting strip materially, particularly polycrystalline strip material. Such process comprises providing a flat chill surface movable relative to a tundish having an orifice for receiving and holding molten metal and having a discharge opening through which molten metal is deliverable to the chill surface. Between the tundish and chill surface, a channel-shaped cross-sectional space serves to confine the cast molten metal for a time sufficient for surface solidification to occur such that the molten metal occupies the volume of the channel shape and forms a thin bar product. The full volume of the channel-shaped cross-sectional space is defined by the tundish and chill surface as the tundish moves relative to the length of the chill surface.

DETAILED DESCRIPTION

Figure 1:
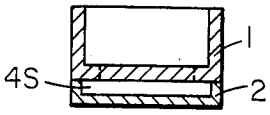
FIG. 1 is a transverse cross-sectional rear view of the tundish of FIG. 5.
Figure 2:
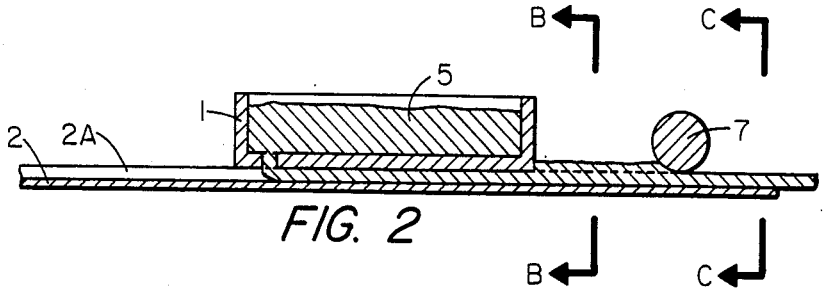
FIG. 2 is a cross-sectional view of a tundish, chill surface, and squeegeeing roll according to this invention depicting a channel-shaped chill surface.
Figure 3:
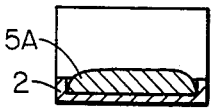
FIG. 3 is a cross-sectional view of a channel-shaped chill surface of FIG. 2 along line BB shown with molten metal deposited from the tundish.
Figure 4:
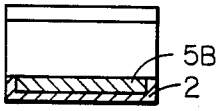
FIG. 4 is a cross-sectional view of a channel-shaped chill surface of FIG. 2 along line CC shown with molten metal squeegeed flat into the channel shaped chill surface.
Figure 5:
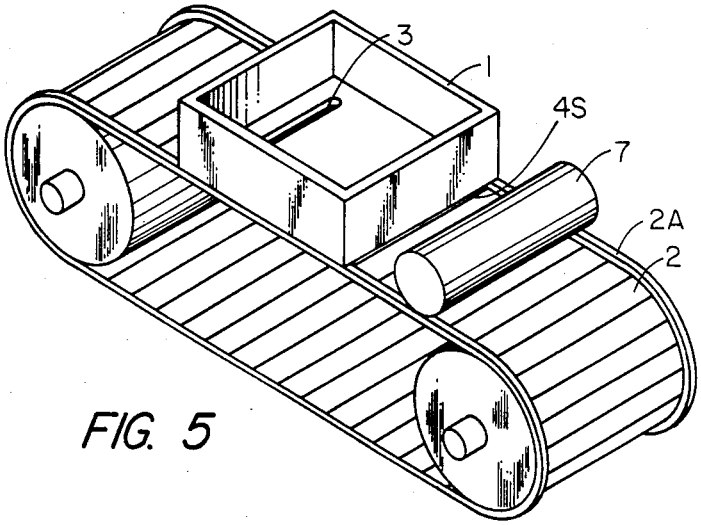
FIG. 5 is a view of a tundish and channel-shaped chill surface having a cross-sectional channel-shaped space, largely defined by the chill surface. A fixed roller apparatus is also depicted.

Referring particularly to the drawings, FIGS. 2 and 5 generally illustrated the process of the present invention of casting molten metal into a channel-shaped space. By restricting two directions of flow of the melt, the molten metal is substantially confined to a uniform bar shaped volume.

In FIG. 5 the tundish 1 is shown positioned on chill surface 2. Tundish 1 has molten metal discharge opening 3 through which molten metal contacts the chill surface and fills channel-shaped space 4S.

FIGS. 2 and 5 in particular illustrate molten metal 5 being discharged through discharge opening 3. Molten metal 5A prior to squeegeeing is rounded by surface tension and shown as uniformly smooth metal 5B after squeegeeing with chill roll 7.

In FIGS. 1 through 5 the channel-shaped space 4S is located in the chill surface. FIG. 5 depicts the channel shaped chill surface 2 as a segmented belt. Tundish 1 rides on flanges 2A.

The present invention allows an improvement over melt drag processes in that thicker and shaped polycrystalline strips can be cast.

It has been found particularly advantageous to provide a squeegee preferably in the form of a chill roll 7 to immediately smoothen or squeegee the melt in the channel-shaped space. The roller, preferably resting and riding on the raised sides of the chill surface, hastens quenching and equalizes the top side in terms of polycrystallinity with the polycrystalline surface of the side of the melt contacting the flat chill surface.

The chill surface can be a flat or channel-shaped length of metal or can be made into a belt, for example, composed of small composite segments. Copper is preferred as the chill surface through other heat conducting materials can be used. The chill surface must be able to absorb the heat from contact with molten metal. With more continuous operations, cooling by conduction can be augmented by using fluid, namely water, cooling through or to the underside of the chill surface. Refrigerated fluids or gases can also be advantageously used. As would be evident, such cooling can be applied to all chill surfaces described herein including the cooling squeegee or roll.

The chill surface is moved relative the tundish at a rate preferably about 1 meter/second and up to 2.5 meters per second. The ideal rate of movement is the rate the melt is leaving the tundish.

This process enables manufacture of strip of a lesser thickness than that dictated by the surface tension of the metal. Molten metal has an inherent thickness due to surface tension of the melt; however, the strip formed from the melt by this invention has a solid undersurface layer formed upon contact with the chill surface. Over the solid layer a molten layer is carried along wetted to the solidified underlayer. The molten layer is immediately hot rolled, actually squeegeed so as to cool, thin, smooth and solidify the top surface. Such two sided cooling enables obtaining a smoother strip whose surfaces are of relatively uniform microstructure.

This hot rolling is enabled because the cast metal has a strong thermal gradient, more specifically a wet or molten top surface but a solidified undersurface. Normally, hot rolling of just-cast hot metal would ruin the casting.

Hot rolling or using double roll systems previously had been problematic and has not been widely practiced in the industry. This process makes hot rolling useful in a more simple but effective manner to yield a more uniform product having substantially similar top and bottom surfaces.

In practicing this invention, the channel—shaped area is formed in the substrate. This can be conveniently accomplished by use of a one piece chill surface with carved channel or assembled from a flat bar plus edges, shims or flanges 2A on either side of the chill surface 2 and on which the tundish rides. Advantageously the chill surface can be a copper segment belt with two copper shimming belts defining a channel-shaped chill surface between them. A particularly efficient way of placing the shimming belts is around three rollers external to the copper segment chill surface belt. The tundish then can be placed riding on the shims but within the circuitous, triangular, path traveled by the shimming belts around and over the tundish. The shimming belts would lift off the chill surface after strip solidification. In this manner shorter shimming belts can be used.

To change strip metal thickness, a different thickness shim or flange can be applied.

In the preferred embodiment, the tundish discharge opening is selected such that when the molten metal is cast into a strip the strip's edges do not actually make substantial contact with the shimming material until after rolling or squeegeeing. This procedure can avoid some materials problems associated with intense heat transfer including shrinkage, warpage, and the like. Simple copper strapping material can be made into a useful shimming belt.

The shim material is preferably loosely held against the chill surface rather than bolted or screwed to the chill surface. The heat absorbed from the molten metal tends to buckle and warp the shim material if bolted, therefore, less rigid adherence is preferred, the optimal amount of securing being readily ascertainable.

A revolving channel-shaped belt as the chill surface would be preferred. The belt would move at less than 2.5 m/sec, preferably about 1 meter/second.

In FIG. 5, the tundish floor has an orifice serving as a discharge opening 3 substantially centrally located and toward the forward end of the tundish. The longitudinal extent of discharge opening 3 approximates the approximate width of the strip to be cast. Uniform flow of metal through the discharge opening is provided by maintaining a quantity of molten metal in the tundish to exert a metallostatic head pressure sufficient to cause flow out discharge opening 3 as the tundish or chill surface is moved.

The tundish is advantageously constructed of heat insulating material such as firebrick. Other molten metal resistant materials can also be employed including by way of illustrations graphites, carbides such as silicon carbide, alumina, or zirconia.

The process of the present invention yields a thicker bar product than the strips of the prior art. This bar product is polycrystalline and can be rolled to sheet products with less rolling and less energy expenditure than the currently practiced mill rolling operation.

The method for casting metal strip from a melt according to this invention comprises the steps of: providing a flat chill surface; providing a tundish having an orifice for receiving and holding molten metal and having a discharge opening through which molten metal is deliverable to the chill surface as the tundish is moved relative the chill surface; and providing a channel-shaped cross-sectional space whose volume is defined by the chill surface and tundish as it moves relative the length of the chill surface. Then, a quantity of molten metal is introduced into the tundish, the molten metal having a surface tension such that the metal flows from the tundish through the discharge opening and into the channel-shaped space as the tundish is moved relative the length of the chill surface. Finally, after metal introduction, the tundish is moved relative the chill surface such that a thin bar strip of metal is cast within the volume of the channel-shaped space.

Since the motion of the tundish is relative the chill surface, of course either any one or both can be moved to provide relative motion. Squeegeeing of the cast strip can be accomplished using a roll having a chill surface. Such rolling or squeegeeing should be accomplished at the point the cast melt undergoes thermal shrinkage and unsticks from the underlying chill surface or belt substrate.

The above process for casting strip material can be practiced by providing a channel-shaped chill surface comprising a flat length of metal having raised sides defining a channel therebetween. A tundish for receiving and holding molten metal having a discharge opening therein can be provided through which molten metal is deliverable to the chill surface as the tundish is moved relative the chill surface. A reservoir of molten metal should be provided in the tundish at a gas overpressure or metallostatic head pressure sufficient to cause melt flow from the tundish. At least one-quarter pound per square inch as the discharge opening within one second after pouring is initiated would be sufficient head pressure. Additional molten metal should be poured into the tundish at a rate sufficient to maintain a substantially constant pressure at the discharge opening through the casting operation.

Alternatively, one can provide a channel-shaped chill surface comprising a flat length of heat conducting material preferably in belt form having raised sides defining a channel therebetween such as exemplified in FIG. 5. A tundish for receiving and holding molten metal having a discharge opening therein can be provided through which molten metal is deliverable to the chill surface as the tundish is moved relative the chill surface. It would be advantageous to additionally provide a squeegee 7 or chilled roll resting and riding on the raised sides of the chill surface spanning the channel of the chill surface. A quantity of molten metal can then be introduced into the tundish. After metal introduction, the tundish can be moved relative the chill surface such that a thin strip of metal, preferably of 0.02–0.5 inches thickness, is cast within the channel of the channel-shaped chill surface. The cast strip next is rolled so as to squeegee the molten top surface of the metal cast within the channel of the channel-shaped chill surface.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit of the invention.

I claim:

1. A process for casting strip material comprising:

(a) providing a channel-shaped chill surface comprising a flat length of heat conducting material having raised sides defining a channel therebetween, (b) providing a tundish for receiving and holding molten metal having a discharge opening therein through which molten metal is deliverable to the chill surface as the tundish is moved relative the chill surface, (c) providing a squeegee resting and riding on the raised sides of the chill surface spanning the channel of the chill surface, (d) introducing a quantity of molten metal into the tundish, (e) moving, after metal introduction, the tundish relative the chill surface such that a thin strip of metal is cast within the channel of the channel-shaped chill surface, (f) squeegeeing the cast strip so as to squeegee the molten top surface of the metal cast within the channel of the channel-shaped chill surface.

2. The method according to claim 1 wherein the tundish is stationary and movement of the chill surface provides the relative movement.

3. The method according to claim 1 wherein the chill surface provided is a belt.

4. The method according to claim 3 wherein the belt moves at a speed of approximately 1 meter per second.

5. The method according to claim 3 wherein the belt moves at a velocity substantially/equal to the velocity the molten metal leaves the tundish.

6. The method according to claim 1 wherein the molten metal introduced to the tundish is introduced in a quantity such that a metallostatic head pressure of at least one-quarter pound per square inch at the discharge opening develops within one second after said molten metal introduction.

7. The method according to claim 6 including the additional step of introducing additional molten metal into the tundish at a rate sufficient to maintain a substantially constant pressure at the discharge opening through the casting operation.

8. The method according to claim 1 wherein the squeegeeing is accomplished using a chilled roll.

9. The method according to claim 1 wherein the strip cast is from 0.02–0.5 inches thick.

* * * * *